US005370754A

United States Patent [19]

Soloman

[11] Patent Number: 5,370,754

[45] Date of Patent: Dec. 6, 1994

[54] AUTOMATIC MOTORLESS LABEL APPLYING SYSTEM

[75] Inventor: Sabrie B. Soloman, Ridgewood, N.J.

[73] Assignee: Pfizer Inc., New York, N.Y.

[21] Appl. No.: 63,070

[22] Filed: Jun. 3, 1993

Related U.S. Application Data

[63] Continuation of Ser. No. 722,055, Jun. 27, 1991, abandoned.

[51] Int. Cl.[5] ..... B65C 9/00

[52] U.S. Cl. ..... 156/64; 156/361; 156/542; 226/32; 226/149

[58] Field of Search ..... 156/361, 363, 540, 541, 156/542, 504, 64; 226/147, 149, 150, 32

[56] References Cited

U.S. PATENT DOCUMENTS

| | | | |
|---|---|---|---|
| 2,712,393 | 7/1955 | Brown | 156/DIG. 10 X |
| 4,189,337 | 2/1980 | Higgens et al. | 156/541 X |
| 4,262,855 | 4/1981 | Haag | 156/504 X |
| 4,270,968 | 6/1981 | Dudzik et al. | 156/542 X |
| 4,585,506 | 4/1986 | Matsuguchi | 156/542 X |
| 4,895,614 | 1/1990 | Trouteaud et al. | 156/542 |
| 5,022,954 | 6/1991 | Plaessmann | 156/542 |
| 5,052,606 | 10/1991 | Cipolla et al. | 226/149 X |

*Primary Examiner*—David A. Simmons
*Assistant Examiner*—James J. Engel
*Attorney, Agent, or Firm*—Peter C. Richardson; Paul H. Ginsburg; Grover F. Fuller, Jr.

[57] ABSTRACT

An automatic motorless label applying system includes a supply reel having a continuous carrier strip with a plurality of labels detachably mounted thereon. The strip is directed through an air actuated linear indexing mechanism which includes an upstream solenoid and a downstream solenoid. The upstream solenoid has clamp members which clamp the strip and then move it in a down-stream direction by the upstream solenoid itself moving laterally. The downstream solenoid clamps the strip when the upstream solenoid returns towards its original position. The labels are sequentially detached from the strip and each label is applied to a respective container.

31 Claims, 11 Drawing Sheets

10
110
114
22
116
117
66
114
62
64
20
18
68
70
78
60
72
74
70
26
24
120
126
122
124
24
120

AUTOMATIC MOTORLESS LABEL APPLYING SYSTEM

This is a continuation, of application Ser. No. 07/722,055, filed on Jun. 27, 1991, now abandoned.

BACKGROUND OF INVENTION

The present invention is directed to a label applying system. Such systems have utility in various fields, including the application of labels to bottles, such as in the pharmaceutical industry. It is desirable that such a system should be adaptable to mass production techniques so that labels could be applied at high speed to bottles or other containers which likewise move at high speed. It would also be desirable if such a system could effectively operate without the need for complicated motors and gear trains. Ideally such a system should incorporate safety mechanisms to automatically turn off the system when an unsafe condition is detected. Additionally, such a system should have the capability of sensing when errors in the system, such as missing bottles or caps occur.

SUMMARY OF INVENTION

An object of this invention is to provide an automatic motorless labeling system which fulfills the above needs.

A further object of this invention is to provide such a system which has particular utility for labeling bottles, such as used in the pharmaceutical industry.

In accordance with this invention, the automatic motorless label applying system includes a supply reel having a continuous carrier strip with a plurality of pressure sensitive labels detachably mounted on the carrier strip. The labels bass through a linear indexing mechanism which includes an upstream clamping device and a downstream clamping device. The upstream clamping device is laterally movable toward and away from the downstream clamping device when the upstream clamping device is in its clamping position. When the upstream device moves toward the downstream device it pulls the strip along with it. The downstream clamping device is then actuated to clamp the strip while the upstream clamping device returns toward its original position. The labels are sequentially detached from the carrier strip and applied to containers being fed one at a time to an applicating station.

In a preferred practice of the invention the linear indexing mechanism is air actuated and the clamping devices are solenoid operated. The system preferably also includes a spring loaded mechanism upstream from the linear indexing mechanism. The spring loaded mechanism would be actuated when there is a pressure drop in the system so that the spring loaded mechanism would then clamp the carrier strip to maintain the strip under tension.

Sensors may be suitably positioned for determining various conditions, such as uneven spacing between labels, misalignment of the carrier strip, the absence or misalignment of a container and the like. The mechanism for applying the labels is preferably a Cartesian robot which lifts each label after at least partial detachment from the carrier strip and then laterally moves the label to the applicating station. The robot then lowers the label into pressure contact with the container.

THE DRAWINGS

Figure 17:
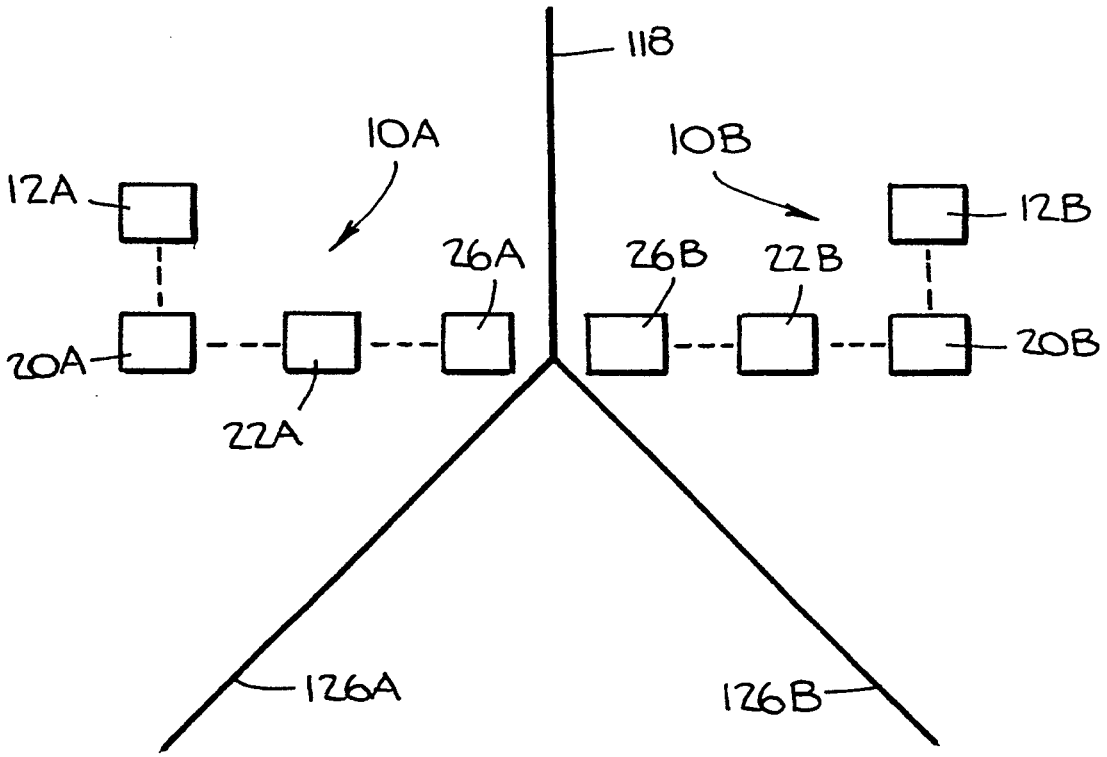

FIG. 17 schematically illustrates a flow diagram in a variation of the invention;

FIG. 18 is a top plan view of a modified form of this invention; and

Figure 19:
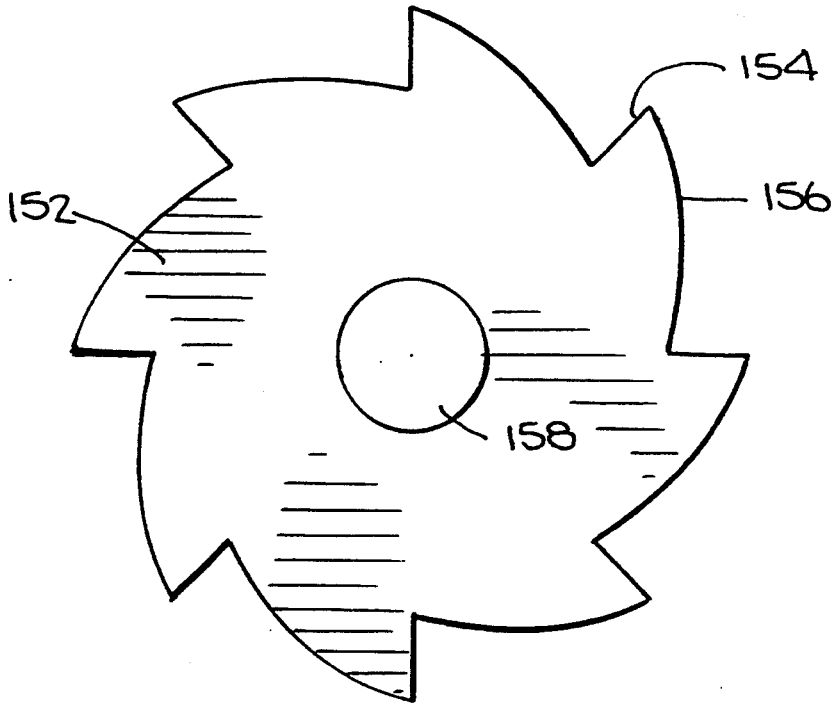
Figure 10:
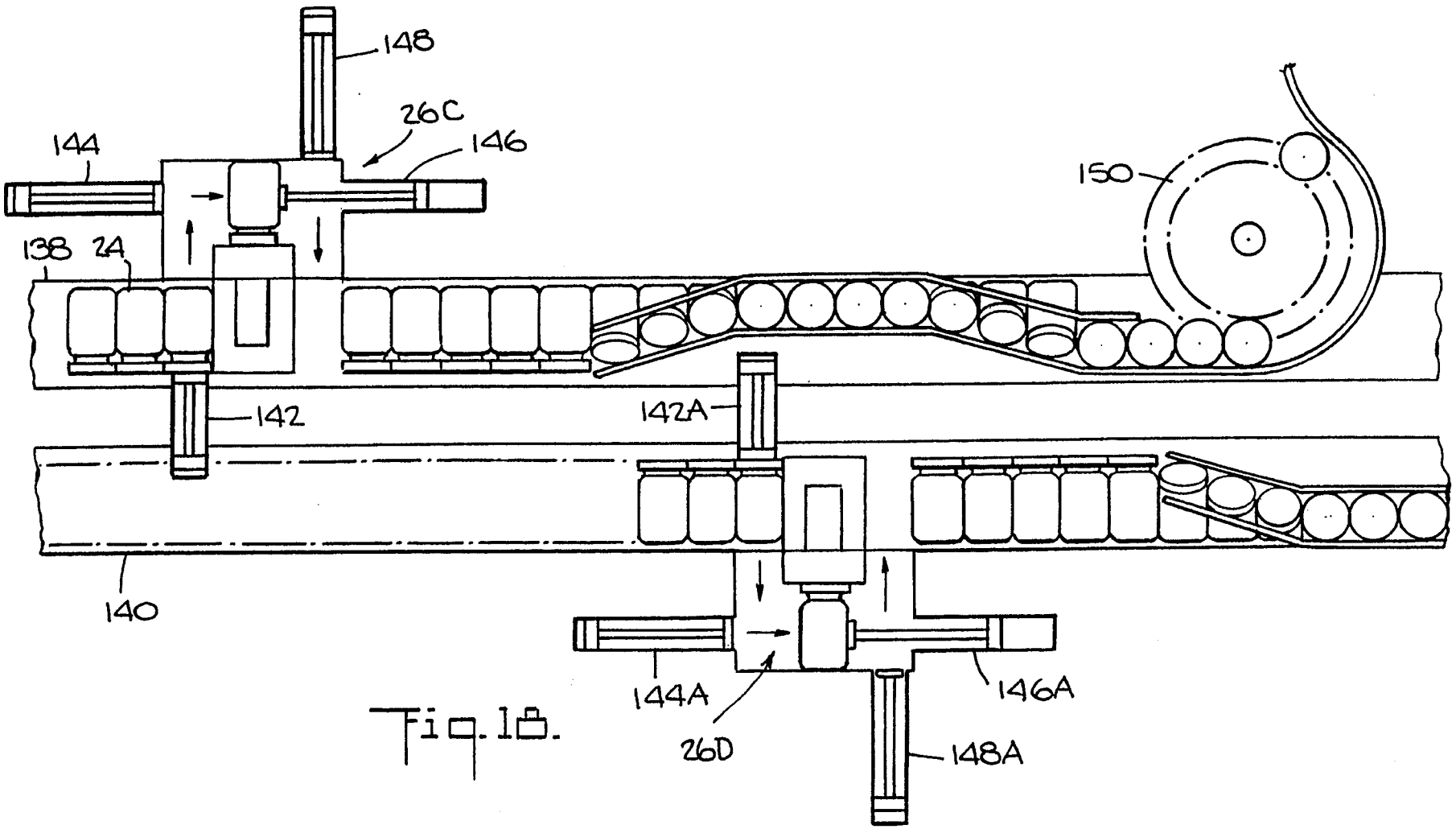

FIG. 19 is a front elevational view of a modified bottle receiving wheel in accordance with this invention.

DETAILED DESCRIPTION

Figure 3:
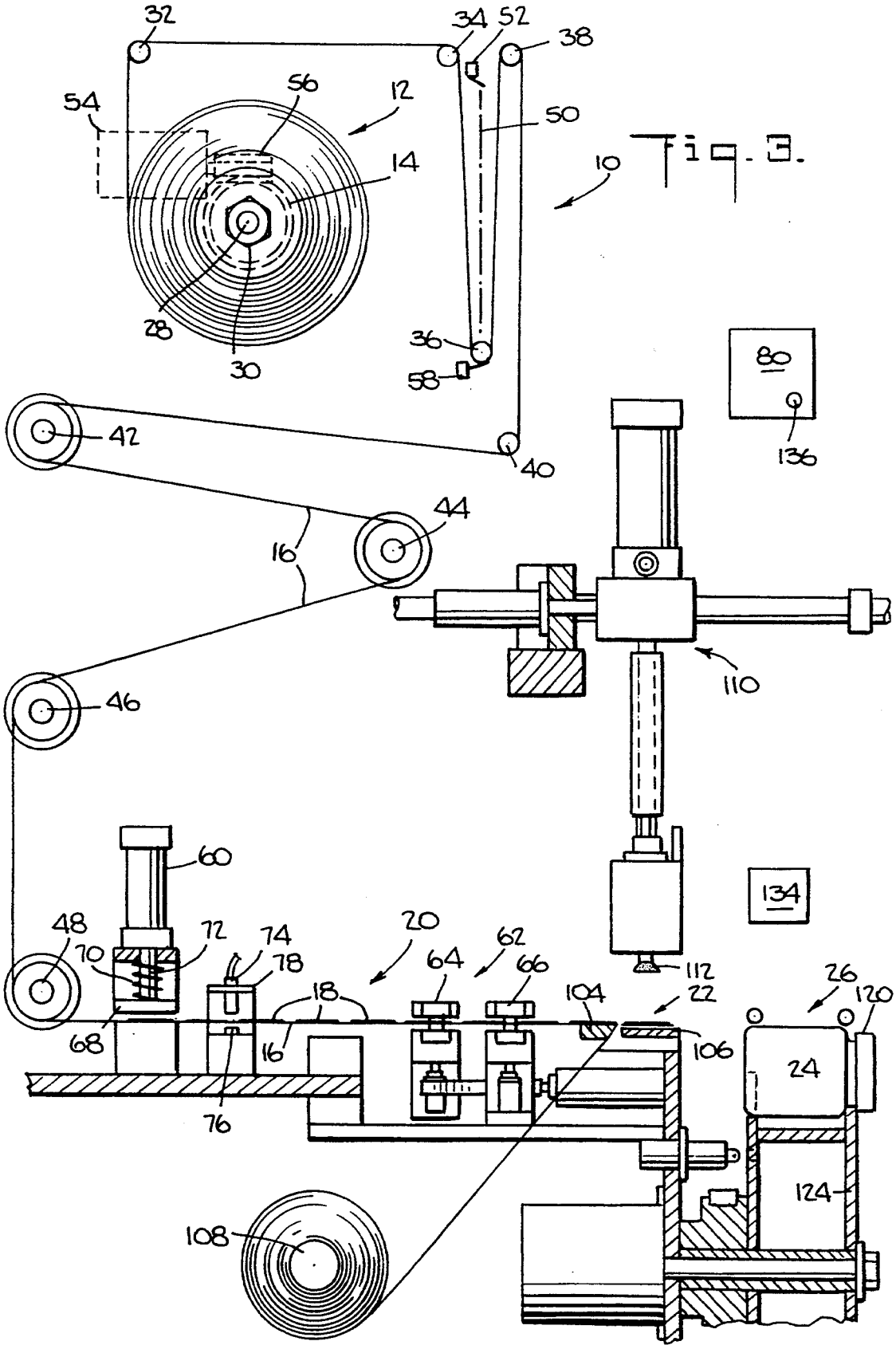
FIG. 3 is a front elevational view partly in section showing the path taken by the carrier strip in the system shown in FIGS. 1–2.

The present invention is directed to an automatic motorless labeling system 10 which is capable of applying labels in mass production operation. Such labels could be applied to any surface and has particular utility for being applied to flat sided containers, such as bottles used in the pharmaceutical industry. The general operation of system 10 is illustrated in FIG. 3. As shown therein, system 10 includes a supply station 12 which contains a reel 14 having a continuous strip of carrier material 16 made of any suitable material such as non-adhesive wax paper. Each reel may contain in excess of 60,000 labels 18. From the supply station 12 the label carrying strip is conveyed to a drive station 20 and then to a detaching station 22 where the labels 18 are detached from the carrier strip 16 and applied to bottles 24 at applicating station 26.

Reel 14 is supported by a shaft 28 with a set of bearing blocks 30 on one side of the reel 28. The other side has a sliding collet (not shown) placed against the reel and tightened on the shaft 28 to prevent any relative sliding motion.

The reel 14 is also attached to an anti-drag mechanism to counteract the effect of inertia forces created during operation. As shown in FIG. 3 the carrier strip 16 is wound around dancers or rollers 32, 34, 36, 38, 40, 42, 44, 46 and 48 which convey the strip 16 into the drive station 20 to correct any possible misalignment of the reel strip 16. The anti-drag mechanism includes dancer or roller 36 which is a sliding roller mounted for vertical movement along the path indicated by the line 50. When the tension in strip 16 increases roller 36 moves upwardly until it strikes a micro-switch 52 which is connected to control mechanism 54 having a drive member 56 engaged with reel 14. Drive member 56 would cause shaft 28 and reel 14 to turn clockwise which would allow more slack to be created in strip 16. Roller 36 would then move downwardly until it contacts lower micro-switch 58 when there is too much slack which would then actuate drive 56 to cause reel 14 to move in a counterclockwise direction.

Drive 56 could be a shaft. Control 54 could be a motor rotating the shaft 56. The shaft of drive 56 could terminate in a threaded portion engaged in teeth around reel 14 to control the direction of rotation of reel 14. Such operation would be similar to a rack and pinion. Alternatively, the threaded shaft might engage teeth on shaft 28 for reel 14.

As also shown in FIG. 3, the drive station 20 includes a spring loaded mechanism 60 and an air actuated linear indexing mechanism 62 which consists of an upstream clamping device 64 and a downstream clamping device 66. Clamping devices 64 and 66 are preferably two sets of pneumatic solenoids actuated simultaneously. The purpose of the linear indexing mechanism 62 is to advance the strip 16 automatically and thus act as the power to drive the entire system. As a result, the need for complicated motors and gear trains is eliminated.

Figure 1:
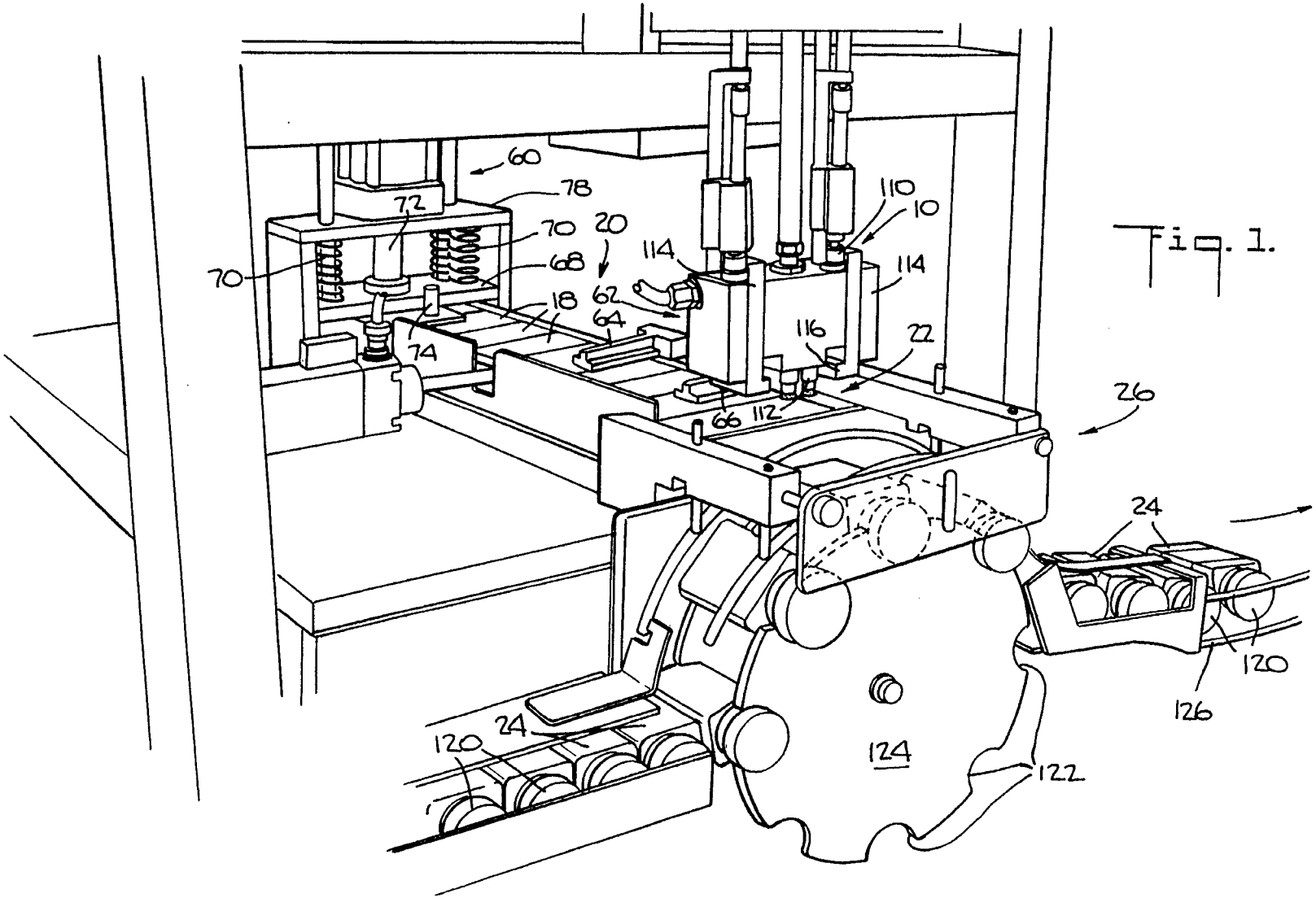
FIG. 1 is a perspective view of an automatic motorless label applying system in accordance with this invention.

Spring loaded mechanism 60 functions to hold the strip 16 when the applied pressure in the system drops to a minimum level. As a result, spring loaded mechanism 60 prevents the strip 16 from sliding backward and causing misalignment. Spring loaded mechanism 60 may take any suitable form. As illustrated in FIGS. 1 and 3, spring loaded mechanism 60 includes a plate 68 disposed slightly above the path of travel of strip 16. A series of springs 70 are provided to urge plate 68 downwardly. The urging of springs 70, however, is overcome by a pneumatic piston cylinder arrangement 72 which holds plate 68 at its normal position during the normal operation of system 10 where there is no contact of plate 68 with strip 16. When there is an air pressure drop in the system, such as the air pressure used for actuating linear indexing mechanism 62 there will also be an air pressure drop in piston cylinder assembly 72 which in turn would then permit the action of springs 70 to cause plate 68 to move downwardly into contact with strip 16 thereby locking the strip in position to prevent strip 16 from sliding backward.

After strip 16 passes through spring loaded mechanism 60 it is advanced past sensor 74. Sensor 74 directs a beam of light toward the edge of strip 16 to detect if there is any misalignment or uneven spacing of the labels 18. Sensor 74 may take any suitable form, such as being a photodetector having a receiver 76 below the edge of strip 16. Sensor 74 and receiver 76 could be mounted any suitable manner such as on mounting bracket 78. If an uneven spacing of successive labels 18 is detected the information is fed to the controller 80 which controls the operation of system Controller 80 is shown schematically in block form and in actual practice would be a suitable electronic pneumatic programmable controller. When the amount of uneven spacing has accumulated beyond an acceptable distance, a correction mechanism is actuated to compensate for that spacing.

Figure 11:
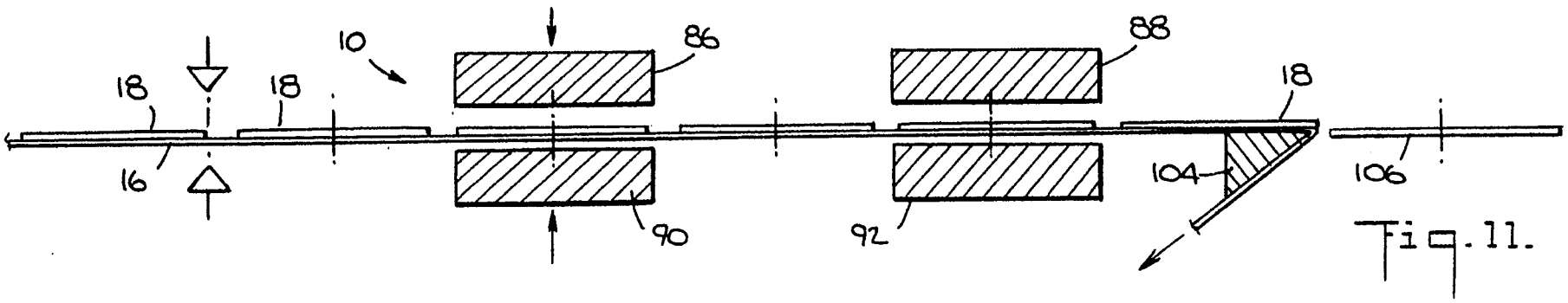
FIGS. 11–13 are side elevational views partly in section showing different stages of operation of the linear indexing mechanism in the system shown in FIGS. 1–10.
Figure 12:
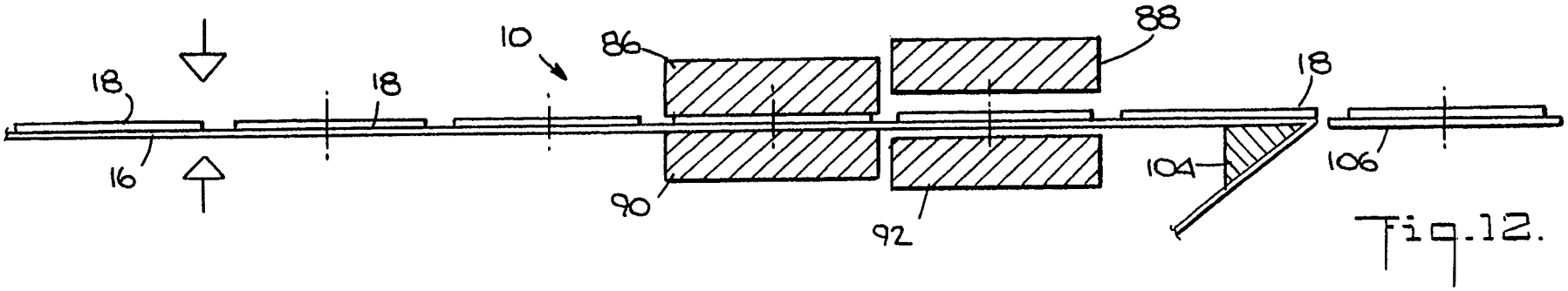
Figure 13:
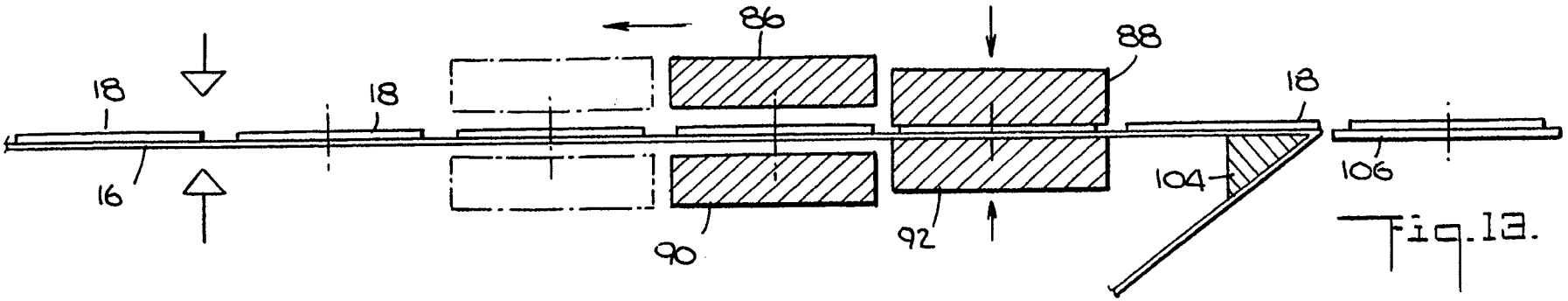

A significant part of this invention is the linear indexing mechanism 62 which permits the system 10 to operate without the need for complicated motors and gear trains. The details of indexing mechanism 16 are best shown in FIGS. 1-3 and 11-16. FIGS. 11-13 illustrate the general operation of the linear indexing mechanism. As shown therein, an upstream clamping device 64 and a downstream clamping device 66 are disposed along the path of travel of strip 16. Each clamping device includes a respective upper clamping member 86,88 and a lower clamping member 90,92. As shown in FIG. 11 the upper and lower clamping members are spaced from each other by a distance sufficient to permit the labeling carrying strip 16 to pass therethrough. Clamping members 86,90 of the upstream clamping device 64 would be actuated to be moved relatively toward each other and clamp the label carrying strip as indicated by the arrows in FIG. 11. Upstream clamping device 64 would then move laterally toward downstream clamping device 66 while in the clamped condition as shown in FIG. 12. During these stages of operation downstream clamping device 66 remains in its open or unclamped condition. As shown in FIG. 13, however, downstream clamping device 66 is then actuated to clamp the label carrying strip 16 and while in this clamped position upstream clamping device is opened and returns toward its original position which is indicated in phantom in FIG. 13. This sequence is repeated to advance the label carrying strip 16 in a forward or downstream direction without the need for the conventional motorized drive required in prior art systems.

Figure 14:
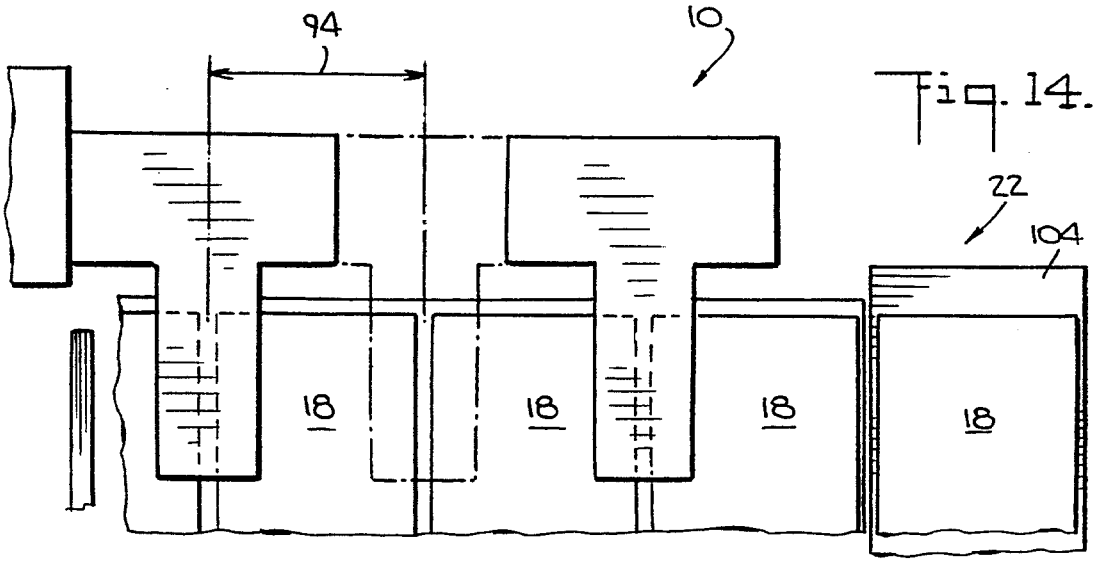
FIGS. 14–16 are top plan views showing different stages of operation of the linear indexing mechanism shown in FIGS. 11–13.
Figure 15:
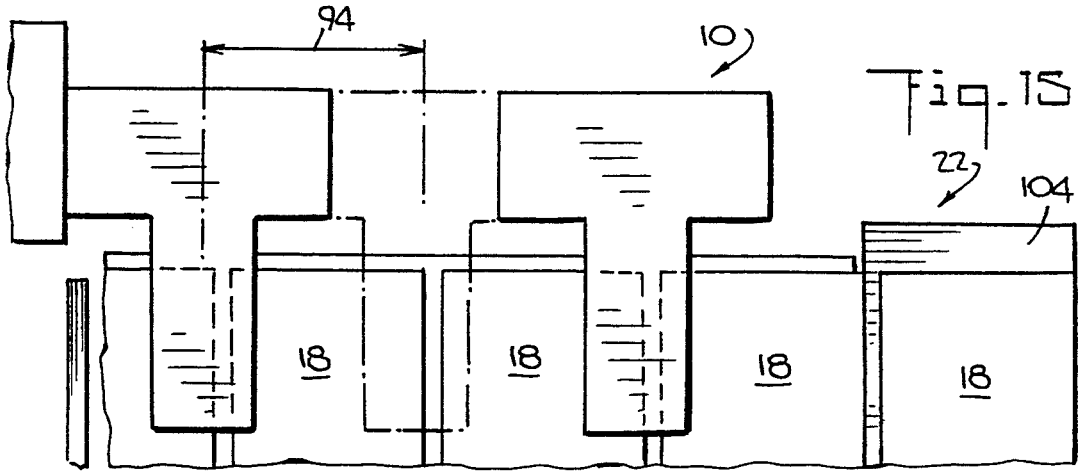
Figure 16:
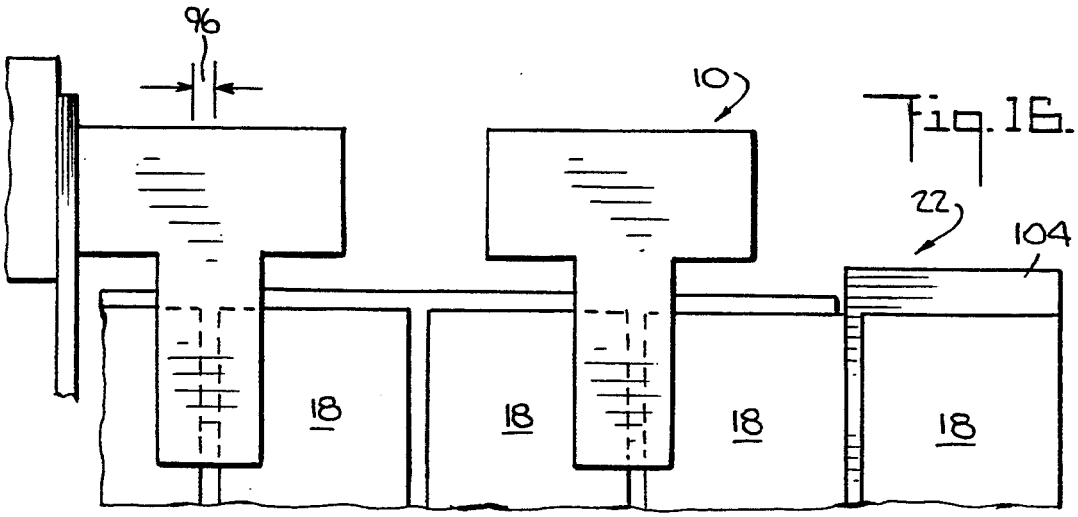

FIGS. 14-16 illustrate in plan view the sequence of operation of clamping devices 64,66. As shown in FIG. 14 clamping device 64 would move laterally toward clamping device 66 to the position indicated in phantom with the distance of movement indicated by arrow 94. Under normal conditions clamping device 64 would return to its original position. Where, however, a spacing error has been detected which accumulates and exceeds a minimum amount clamping mechanism 82 would be returned a distance which differs from the original distance by an amount sufficient to compensate for the error. FIG. 16, for example, illustrates a spacing 96 which corresponds to a distance location less than the original distance 94 to indicate the location that clamping device 64 would assume for compensating for a spacing error corresponding to the distance 96. As illustrated in FIGS. 14-16 the pitch or distance of movement is determined by comparing the center line of the clamping member in one position with the center line in another position.

Figure 2:
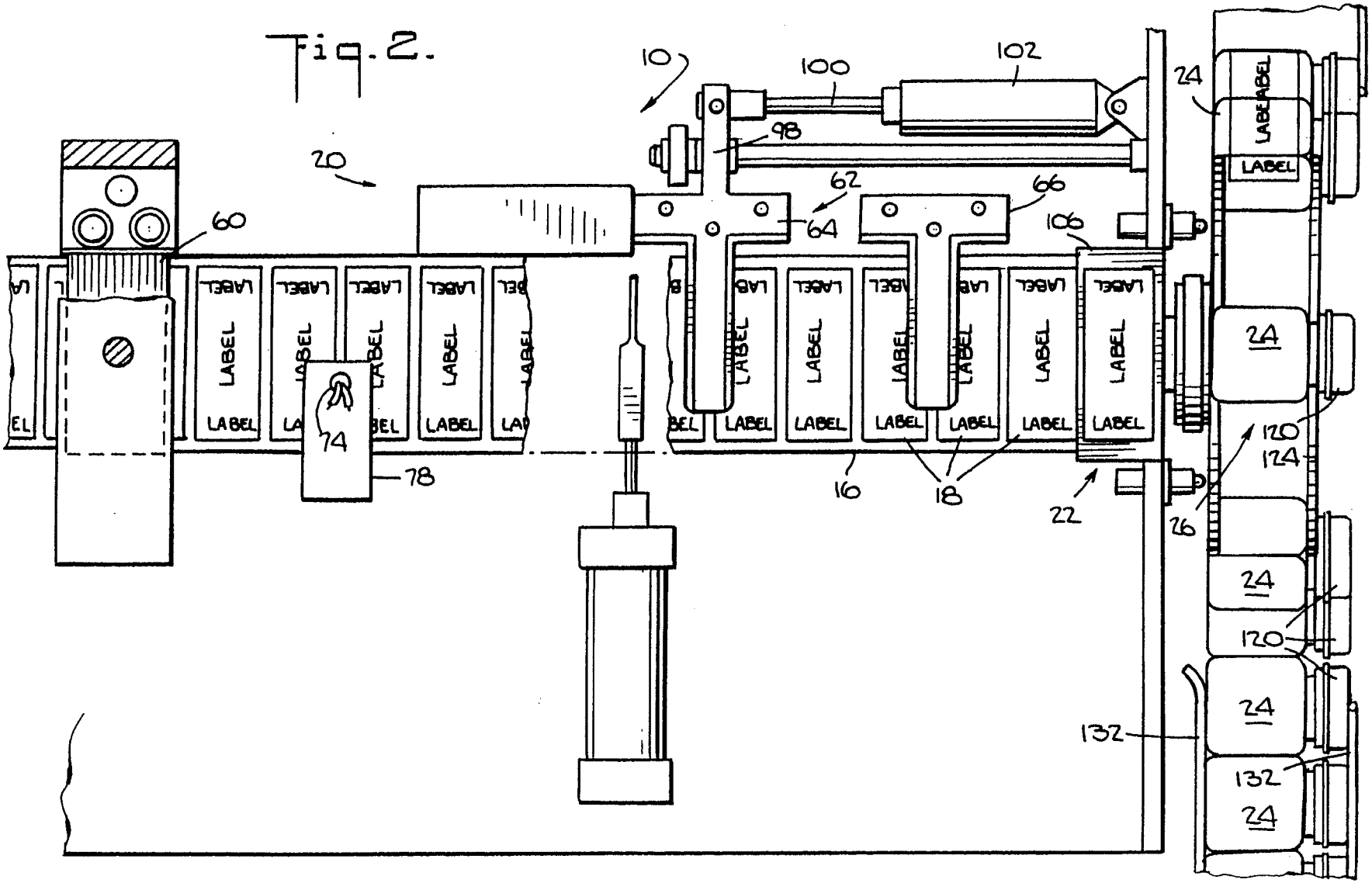
FIG. 2 is a top plan view of a portion of the system shown in FIG. 1 from the spring loaded mechanism to the applicating station.

Clamping devices 64,66 may take any suitable form. In the preferred practice of the invention, however, the clamping devices are two sets of pneumatic solenoids which are actuated simultaneously. As illustrated in FIG. 2 clamping device 64 has an extension 98 which is connected to a piston 100 in air cylinder 102. Thus, the extension and retraction of piston 100 with respect to cylinder 102 controls the lateral movement of clamping device 64. As previously indicated downstream clamping device 66, however, is fixed. Thus, in operation one solenoid, namely clamping device 64 controls the indexing motion as it holds the strip 16 firmly and advances it to a precise location of each label. Before releasing the strip, however, the fixed solenoid or clamping device 66 is activated to hold the advanced strip 16. The moveable solenoid 64 then retracts to its original position ready once again to advance another label 18.

Figure 9:
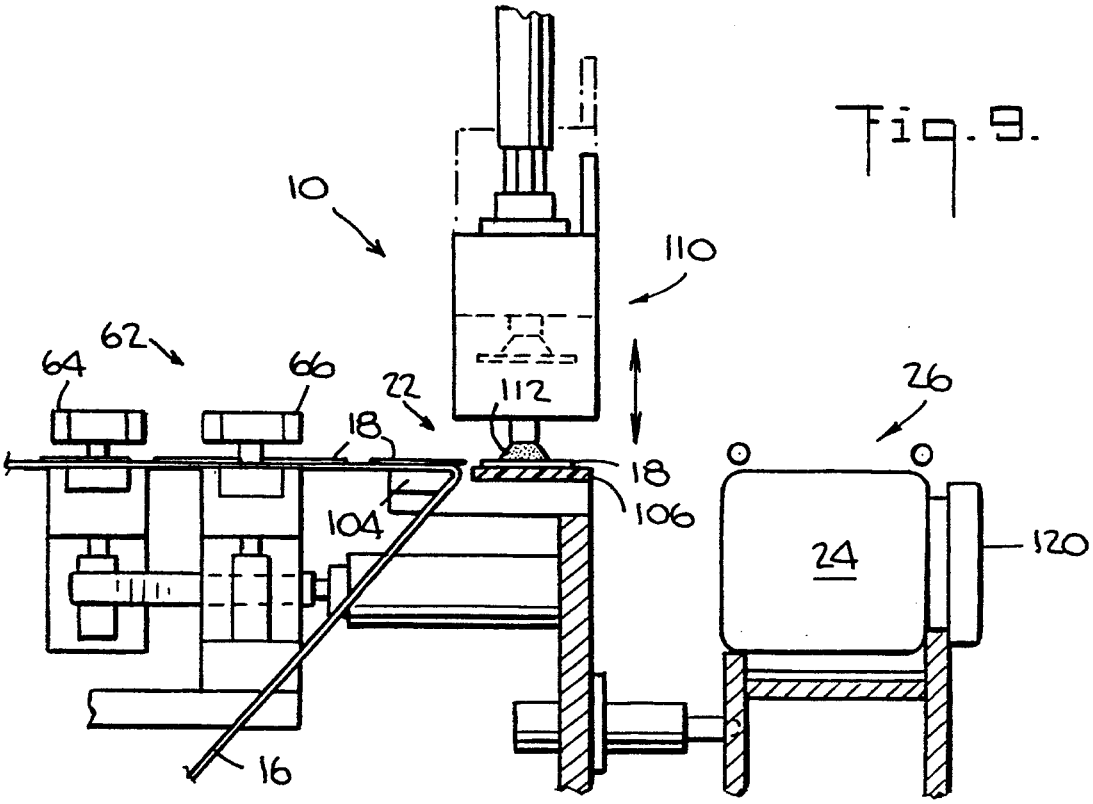
FIGS. 9–10 are side elevational views partly in section showing movement of the robot from the detaching station to the applicating station for the system of FIGS. 1–8.
Figure 10:
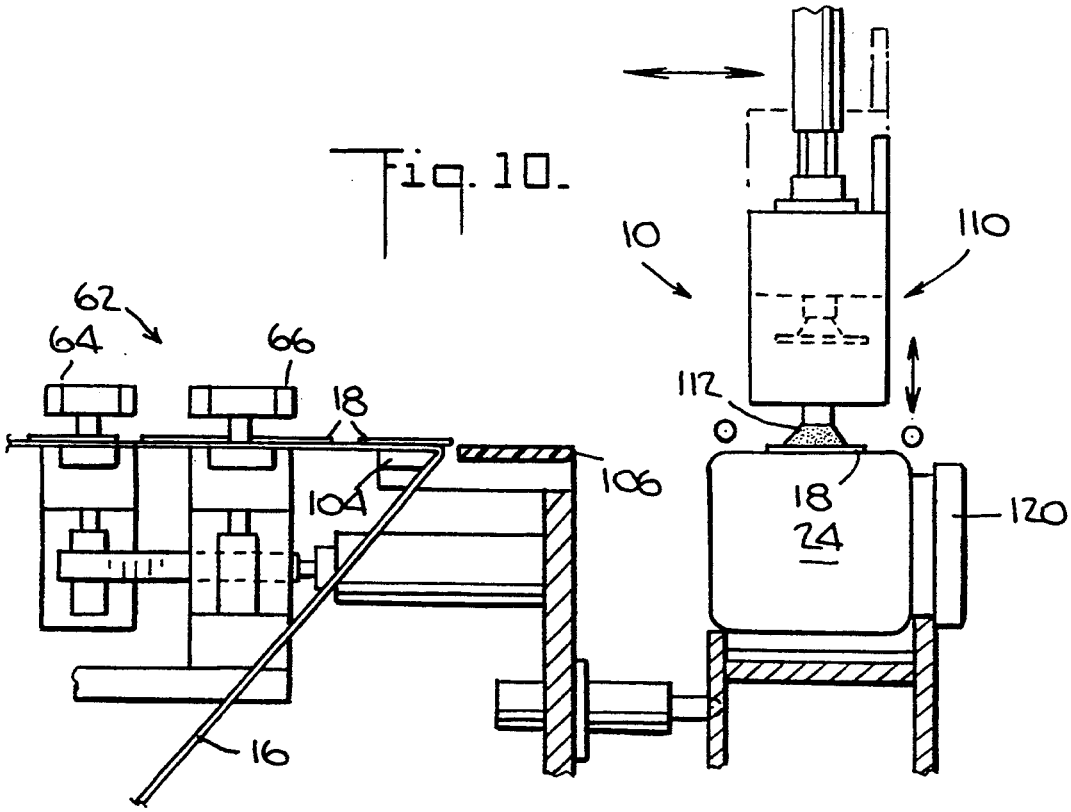

After passing through the drive station 20, the label carrying strip 16 is moved to detaching station 22. The action in detaching station 22 is best seen in FIGS. 9-10 and also in FIGS. 11-13. As shown in FIG. 11, a peeling block 104 is provided downstream from clamping device 66. Peeling block 104 is wedged shaped at an acute angle so that carrying strip 16 must bend over an angle greater than 90°. This sharp bend causes the pressure sensitive labels 18 to peel from the low friction carrying strip 16. Label 18 under the force imparted by moving strip 16 continues to move in a straight line. FIGS. 9–10, for example, illustrate label 18 in the initial stages of peeling from carrier strip 16. After label 16 is completely peeled from carrier strip 16 it becomes deposited on platform 106. Platform 106 has a roughened coarse upper surface such as being made from sandpaper to prevent label 18 from sticking to platform 106. As shown in FIG. 3, carrier strip 16 is taken up by take up reel 108 after leaving detaching station 22.

Advantageously system 10 operates without the need for complicated motors and gear trains. In practice, strip 16 would include a lead or downstream portion which has no labels attached thereto. The labelless lead end of the strip would be threaded around the various rollers and through the various stations until it is mounted to take up reel 108. The first label would be located at any suitable location upstream from detaching station 22. Operation of system 10 would then begin by actuation of linear indexing mechanism 62. In this respect, upstream solenoid device 64 would clamp against strip 16 and pull the strip in a downstream direction to cause supply reel 14 to rotate for feeding an additional segment of strip 16 while take up reel 108 would have a comparable length of strip wound around the take up reel. This incremental movement would continue at a rapid rate until all of the labels 18 which are on strip 16 would be applied to respective bottles. Labels would be applied to the downstream end of strip 16 sufficiently close to end strip 16 as long as a portion at that end of strip 16 is provided to be engaged by linear indexing mechanism 62 for driving strip 16 forward.

After label 18 is detached from carrier strip 16 label 18 is transferred to applicating station 26 where it is applied to a container such as bottle 24. FIGS. 9–10 show the steps in transferring label 18 from detaching station 22 to applicating station 26. As indicated therein the transfer mechanism which in the preferred practice of this invention is a Cartesian robot 110 is mounted for vertical and lateral movement. FIG. 9, for example, illustrates robot 110 to move downwardly so that its lifting arms 112 contact the upper surface of label 18. Lifting arms 112 may take any suitable form and may be, for example, suction arms which pull label 18 into contact with the suction arms and then release the label when the suction is no longer applied. FIG. 9 shows in solid the position of robot 110 when it is initially making contact with label 18. As indicated by the arrow, robot 110 moves in a vertical direction and its elevated position is shown in phantom. Once robot 110 raises label 18 away from platform 106 robot 110 is actuated to move in a lateral direction as indicated by the horizontal arrow in FIG. 10. As shown therein, robot 110 is moved into applicating station 26 where it is located directly above a container or bottle 24 and upon downward movement applies label 18 to the bottle.

Figure 5:
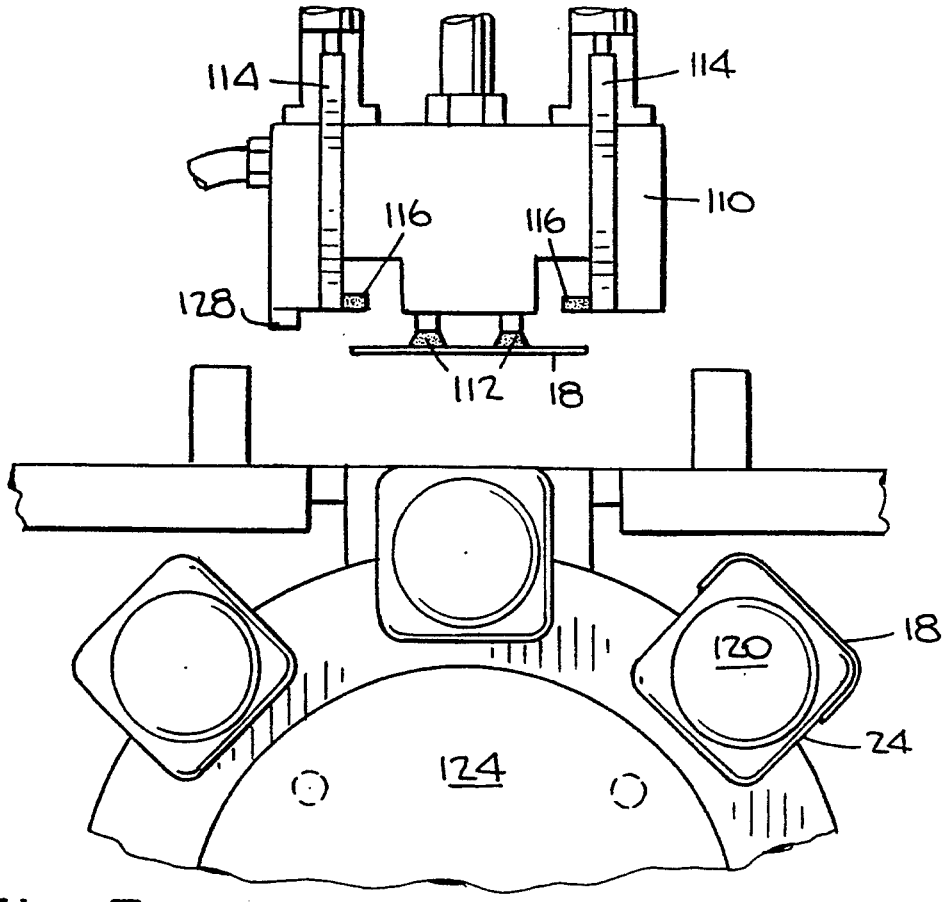
FIGS. 5–8 are end elevational views showing the steps in applying a label to a container in the applicating station of the system shown in FIGS. 1–4.
Figure 6:
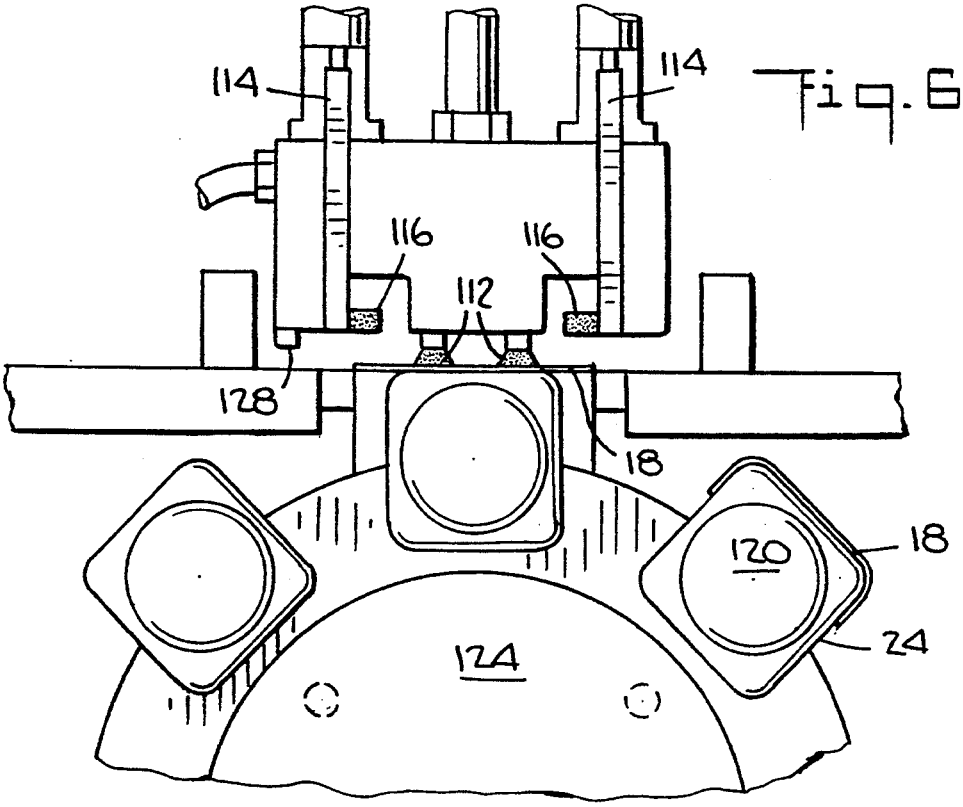

FIGS. 5–8 illustrate the sequence of operation in applying label 18 to bottle 24. FIG. 5 shows the initial stage where robot 110 is elevated above bottle 24. As shown therein, label 18 is in a flat condition held by lifting arms 112. Robot 110 then moves downwardly to the position shown in FIG. 6 where label 18 is pressed into contact with bottle 24. As shown therein, the edge margins of label 18 extend beyond the top surface of bottle 24. Because label 18 is made of pressure sensitive material the depressing action causes label 18 to firmly adhere to the top flat surface of bottle 24 and thus when robot 110 is later mowed upwardly label 18 becomes detached from robot 110 and remains firmly secured to bottle 24.

Figure 7:
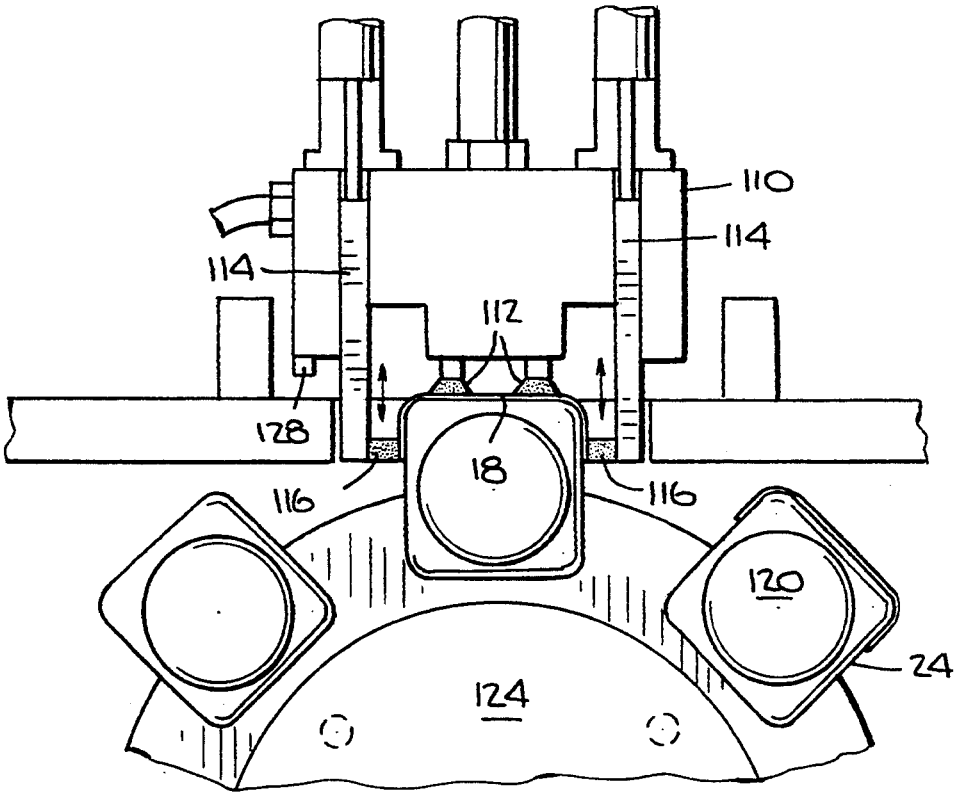
Figure 8:
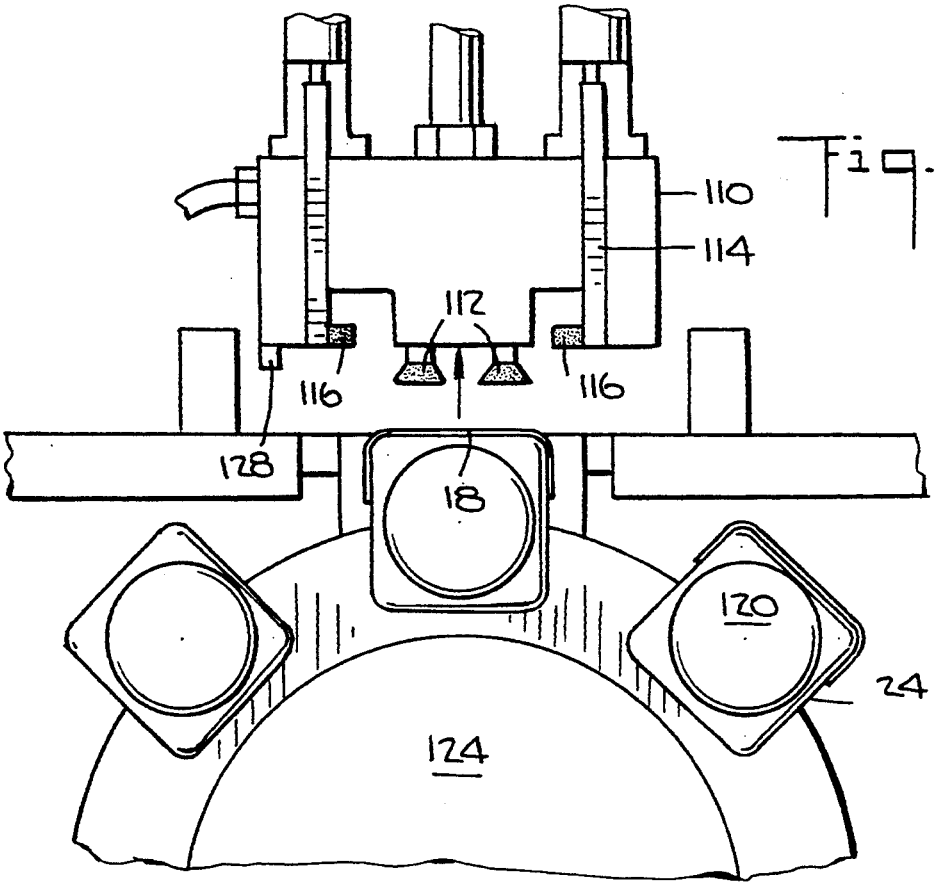

FIG. 7 shows the next sequence of operation where side members 114 of robot 110 continue to slide downwardly carrying squeegee members 116 which press the edges of label 18 against the opposite sides of container 24. Each side members 114 may movably mounted at the end of a piston-cylinder assembly. After label 18 has been thusly applied to container 24 side members 118 and robot 110 are raised as shown in FIG. 8 so that the robot 110 can then move laterally back to detaching station 22 for applying the next label to the next bottle.

Robot 110 may be of any suitable construction capable of moving vertically and transversely and having slide members for affixing the edge of label 18 to the sides of bottle 10. In the preferred practice of the invention robot 110 is a Cartesian robot.

In the illustrated embodiment container 24 is shown as flat sided. Other shapes may be used whereupon the lifting arms of robot 110 would have a complementary shape to press the label against the container surface.

Figure 4:
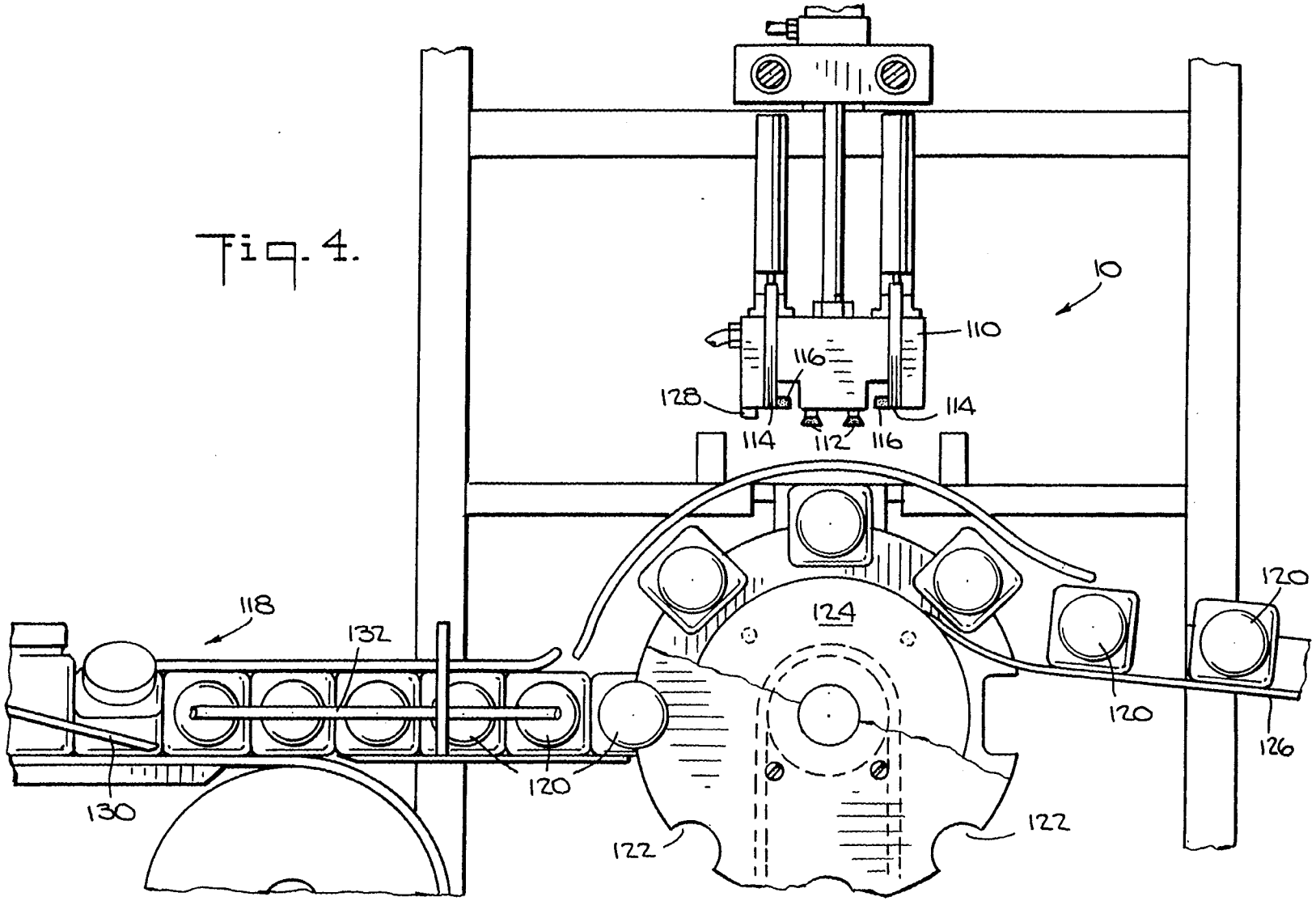
FIG. 4 is a front elevational view partly in section showing the applicating station of the system shown in FIGS. 1–3.

The bottle conveying mechanism for system 10 is illustrated in various figures including FIGS. 1 and 4. As shown therein the bottles are disposed juxtaposed each other across a conveyor 118 with the bottom of each bottle at one edge of the conveyor and the top at the other edge of the conveyor. Each top is closed by a cap 120. Conveyor 118 directs the bottles sequentially into cavities 122 of a rotatable starwheel 124. After a label has been applied the bottles are discharged from the starwheel 124 onto a discharge conveyor 126 for further processing such as packaging.

The present invention includes various safety mechanisms to assure proper operation of system 10. For example, a sensor may be provided such as being located on robot 110 to detect the presence or absence of a bottle from the appropriate cavity of starwheel 124. The sensor 128 is schematically illustrated as being on robot 110 in FIG. 4. When robot 110 is moved to its down position, illustrated in FIG. 6, if the sensor detects the absence of a bottle in the appropriate cavity 122 of starwheel 124 robot 110 will be held at that position and remain there until it is disposed toward a cavity having a bottle. Robot 110 will then proceed with the label applicating steps.

FIG. 4 illustrates additional sensing means for assuring proper operation of system 10. As shown therein, sets of guide bars 130,132 are disposed on the cap side of conveyor 118 with parallel guide bars (FIG. 2) being on the opposite side. The guide bar 130 is disposed for contacting the side of bottle 124 while one guide bar 132 is disposed for contacting its cap. If a bottle is missing the gap in bottles will be sensed when the gap passes guide bar 130. This information will be transmitted to control 80. Similarly, if a cap is missing the gap will be sensed by its guide bar 132 and the information will be transmitted to control 80.

A further feature of system 10 is the inclusion of sensing devices disposed at suitable locations and more particularly for sensing the presence of a foreign object in the vicinity of any or all moving parts. Such a sensing mechanism is schematically indicated by the reference numeral 134 in FIG. 3. The sensing mechanism 134 may be of the radar type which directs a beam toward any or all moving parts. If the beam is broken by a person or object getting too close to the moving part, system 10 is automatically shut down. A reset button, such as button 136 on control 80 may then be actuated to restart system 10. Sensors 134 may also be utilized for shutting down system 10 when various malfunctions are detected, such as a missing or crooked cap, a misaligned bottle, or an empty cavity in starwheel 124.

The invention may be practiced with various modifications. For example, FIG. 17 illustrates and arrangement wherein a single or double conveyor line 118 conveys the bottles to a discharge point wherein there are two mirror image systems 10A and 10B each similar to system 10. Thus, each system 10A and 10B would include its various stations such as feed station 12A, 12B, drive station 20A, 20B, detaching station 22A, 22B and applicating station 26A, 26B. Each applicating station would have its own starwheel. Where a single feed conveyor 118 is used the bottles are alternately delivered to each starwheel of system 10A and 10B and the labeled bottles are conveyed to their discharge area by discharge conveyors 126A and 126B.

It is to be understood that the above description is intended to exemplify the practice of the invention and may be varied without departing from the concepts of the invention. For example, the invention has been described wherein each bottle is disposed for its appropriate label by being located in a cavity of a starwheel. Other manners of conveying the bottles may also be used including a straight line conveyor wherein there is sufficient spacing between adjacent bottles to permit the edges of the label to be adhered to opposite sides of the bottles in addition to the main intermediate side of the bottle. If the labels are smaller than the upwardly disposed side of the bottle then no spacing is required between the bottles since the labels will not extend beyond the one side to which the label is applied.

FIG. 18, for example illustrates a variation of the invention wherein labels are applied to bottles 24 on two separate conveyor lines 138,140. The upstream end of each conveyor line would include a feed station, a drive station and a pealing station as previously described. In the embodiment of FIG. 18, however, the applicating station would differ in that each bottle would be discharged from its conveyor into a modified applicating station 26C. Applicating station 26C would include a robot as previously described for applying the label to the bottle. In application 26C, however, the bottle is disposed for having the label applied by a transfer member 142 which may take any suitable form, such as a piston cylinder assembly which would operate perpendicular to the path of motion of, for example, the conveyor. Thus, as shown in the left hand portion of FIG. 18 a bottle 24 would be moved from conveyor 138 by extension of the piston from transfer member 142 so that the bottle is disposed at the left hand portion of the applicating station 26C. A second transfer mechanism 144 which likewise may be a piston cylinder assembly initially shifts the bottle laterally to the center of the applicating station where the robot applies the label in the manner previously described with respect to robot 110. An additional positioning member 146 which likewise may be a piston cylinder assembly may be used to assure the proper centering of the bottle. This may be accomplished by extending the piston rod to act as a stop when the bottle is transferred toward the center of applicating station 26C. Alternatively the piston rod from member 146 may be extended if necessary to effect a necessary lateral shifting where the bottle is not initially centered by transfer member 144. If desired both piston rods may be extended into contact with the bottle during the label application step. After the label is applied the piston rod from member 146 is retracted. The piston from member 144 is extended full stroke to move the bottle laterally. A further transfer member 148 is activated to shift the bottle back onto conveyor 138.

Conveyor 138 may be designed so that the disposition of the bottle is rotated from a horizontal to a vertical condition as illustrated in FIG. 18. Downstream from the applicating station 26 any suitable discharge member, such a starwheel 150 may be provided for receiving each bottle seriatim and transferring it as previously described.

In the embodiment of FIG. 18 any number of conveyors and applicating stations may be used. The illustrated embodiment shows a second conveyor 142 which would likewise include its corresponding transfer members 142A, 144A, 146A and 148A which operate in the same manner for applicating station 26D as do the corresponding members operate in applicating station 26C. Although not shown, a further discharge member would also be provided downstream from the applicating station.

In one practice of the embodiment of FIG. 18 the piston cylinder assembly 142 would have a two and a half inch stroke. Piston cylinder assembly 144 would have an initial stroke of four and a half inches to center the bottle with the stroke of piston cylinder assembly 146 also being four and a half inches. Piston cylinder assembly 144 would also be capable of having a further extension seven and three-quarter inches to shift the bottle after the label has been applied so that the bottle can be transferred to the conveyor 138. This is accomplished by a five inch stroke for piston cylinder assembly 148. The remote ends of the bottle could be spaced eight and one half inches from the edge of the conveyor when the bottle is in its label receiving position.

FIG. 18 illustrates the practice of the invention without the use of a starwheel such as starwheel 124 at the applicating station. It is to be understood that the invention may also be practiced with other forms of applicating members similar to a starwheel. FIG. 19, for example, illustrates a modified wheel 152 which could operate similarly to starwheel 124. Wheel 152, however, does not include cavities, such a cavities 122. Rather the outer surface of wheel 152 has more of a saw tooth type construction or peripheral which includes a flat radial side 154 and a curved side 156 extending outwardly from the base of radical side 154. The flat radial side functions to support the bottles when the label is being applied. The curved configuration of adjacent side 156 assures that there will be sufficient access to the bottle for label application. Wheel 152 would rotate about shaft 158 in synchronization to a conveyor which supplies the bottles to wheel 152. In the embodiment of FIG. 19 it would be desirable to use some means such as an air jet blowing against the bottle to assure that the bottle makes firm contact with the flat sides 154.

Any suitable programmable controller 80 may be used in the practice of this invention. It is preferred that the controller 80 be an electronic pneumatic programmable controller which is capable of performing a number of sensing functions, such as detecting the absence of a label at any point in the process, detecting the absence of bottles delivered to robot 110 and also detecting the absence of caps from each bottle to assure that each bottle receives a single label placed precisely at the desired references. The system 10 is also intended to count good assembliest rejected assemblies and the number of required assemblies per production unit. Further system 10, in the preferred practice of this invention, is capable of printing, verifying and detecting the presence and absence of the lot number and expiration date for each bottle.

While the invention has been particularly described with respect to applying labels to bottles, in its broadest concept the labels may be applied to other objects including containers of various shapes by the use of air actuators to provide linear and angular motions. System 10 thus provides a means of effectively applying labels at high speed without sacrifice to efficiency so as to lend itself to mass production techniques.

What is claimed is:

1. An automatic motorless label applying system comprising a supply reel having a continuous carrier strip with a plurality of pressure sensitive labels each having at least one leading edge and at least one trailing edge and being detachably mounted on said carrier strip, a linear indexing mechanism, said linear indexing mechanism comprising an upstream clamping device and a downstream clamping device, said upstream clamping device including an upper clamp member and a lower clamp member with said label carrying strip passing therebetween, means for relatively moving said upstream clamp members toward each other to clamp said label carrying strip therebetween, means for moving said upstream clamping device laterally along a distance toward said downstream clamping device when said upstream clamping device is in its clamped condition and for returning said upstream clamping device away from said downstream clamping device when said upstream clamping device is in its unclamped condition, said downstream clamping device being laterally fixed, said downstream clamping device including an upper clamp member and a lower clamp member with said label carrying strip passing therebetween, means for relatively moving said downstream clamp members toward each other to clamp said label carrying strip therebetween while said upstream clamping device is moved in its returning direction, means for sequentially peeling each label from said carrying strip at a detaching station, means for feeding objects one at a time to an applicating station, means for removing each label from said detaching station and applying said label to a respective object at said applicating station, means for sensing at least one leading edge and at least one of the trailing edge of the labels and for sending information when said sensed at least one leading edge and when said sensed at least one trailing edge of a label pass through the sensing means, and means for controlling the lateral movement of the upstream clamping device which receives the information from the sensing means to vary the distance the upstream clamping device is laterally moved so as to substantially maintain even spacing between adjacent labels.

2. The system of claim 1 wherein said linear indexing mechanism is air actuated, and each of said clamping devices comprising pneumatic solenoid actuating devices.

3. The system of claim 2 wherein said means for laterally moving said upstream clamp member is a piston—cylinder assembly.

4. The system of claim 2 including a spring loaded mechanism disposed upstream from said linear indexing mechanism, said strip passing through said spring loaded mechanism, said spring loaded mechanism including a clamping plate disposed for movement into clamping contact with said strip, a plurality of springs attached to said plate for urging said plate into clamping contact, and air actuated means for overcoming the force of said springs to maintain said plate out of contact with said strip whereby said plate is moved into clamping contact with said strip when the air pressure for said air actuated means drops below a minimal level.

5. The system of claim 4 wherein said detaching station includes a peeling member disposed downstream from said linear indexing mechanism, said peeling member having a first surface in line with said linear indexing mechanism and a second surface at an acute angle to said first surface whereby said strip bends at angle greater than 90° when passing over said peeling member to detach each label from said strip, and a platform downstream from said peeling member for sequentially receiving each detached label.

6. The system of claim 5 wherein said platform has a roughened upper surface on which said label is received.

7. The system of claim 5 including a transfer device movable to and from said detaching station and said applicating station, said transferring device being movable vertically and laterally whereby said transfer device may be lowered to lift a detached label from said platform and then raised and shifted laterally to said applicating station for being lowered toward the object to press the label into attachment with the object.

8. The system of claim 7 wherein said transfer device includes vertically slidable side members, each of said side members having an applicator for pressing the edges of said label against opposite sides of the object while the remainder of said label is pressed against an intermediate side of the object.

9. The system of claim 8 wherein said applicators comprise squeegee members.

10. The system of claim 8 wherein said transfer device is a robot.

11. The system of claim 7 including an anti-drag mechanism for varying the tension of said strip, said anti-drag mechanism being operatively connected to said supply reel for controlling the direction of rotation of said supply reel.

12. The system of claim 11 wherein said anti-drag mechanism includes a roller mounted for vertical movement, said strip passing over said roller, said roller creating slack in said strip when said roller moves upwardly and eliminating slack when said roller moves downwardly, switch means at the ends of the path of travel said roller, a drive device actuated by said switch means, said drive device including a driveshaft having a threaded end for engagement with teeth on said supply reel to cause said supply reel to selectively rotate clockwise and counter-clockwise in accordance with the direction of movement of said shaft.

13. The system of claim 7 wherein said applicating station includes a starwheel having a plurality of spaced cavities disposed about its periphery, said starwheel being rotatably mounted for sequentially disposing each cavity toward said transfer device, a feed conveyor for conveying the objects to said starwheel before labels are applied to said objects, and a discharge conveyor for conveying the labeled objects away from said starwheel.

14. The system of claim 13 including guide bars disposed for contacting said objects on said feed conveyor before detecting any gap in the line of objects to sense a missing object.

15. The system of claim 14 wherein said objects are bottles having caps, and said guide bars detecting gaps resulting from missing bottles and missing caps.

16. The system of claim 14 including sensing means for sensing the absence of an object in said cavity disposed toward said transfer device for holding said transfer device in its position prior to the application of a label when an empty cavity is disposed toward said transfer device.

17. The system of claim 16, in combination therewith, a second system arranged in mirror image to said system with a separate discharge conveyor for each of said systems.

18. The system of claim 7 wherein said applicating station includes a rotatable wheel having a series of peripheral teeth, each of aid teeth including a flat radial side and a curved side extending from the base of said flat side, and said flat side comprising a support for the bottle during label application.

19. The system of claim 7 including a conveyor for moving the bottles near said applicating station, and a plurality of transfer devices for moving each bottle to said applicating station and back to said conveyor.

20. The system of claim 19 wherein said plurality of transfer devices comprises four piston cylinder assemblies.

21. The system of claim 1 wherein said detaching station includes a peeling member disposed downstream from said linear indexing mechanism, said peeling member having a first surface in line with said linear indexing mechanism and a second surface at an acute angle to said first surface whereby said strip bends at an angle greater than 90° when passing over said peeling member to detach each label from said strip, and a platform downstream from said peeling member for sequentially receiving each detached label.

22. The system of claim 1 including a transfer device movable to and from said detaching station and said applicating station, said transfer device being movable vertically and laterally whereby said transfer device may be lowered to lift a detached label from said platform and then raised and shifted laterally to said applicating station for being lowered toward the object to press the label into attachment with the object.

23. The system of claim 22 wherein said applicating station includes a starwheel having a plurality of spaced cavities disposed about its periphery, said starwheel being rotatably mounted for sequentially disposing each cavity toward said transfer device, a feed conveyor for conveying the objects to said starwheel before labels are applied to said objects, and a discharge conveyor for conveying the labeled objects away from said starwheel.

24. The system of claim 23, in combination therewith, a second system arranged in mirror image to said system with a separate discharge conveyor for each of said systems.

25. The system of claim 1, in combination therewith, a second system arranged in mirror image to said system with a separate discharge conveyor for each of said systems.

26. A method of applying labels to objects with the use of an automatic motorless label applying system including the steps of mounting a continuous carrier strip having a plurality of pressure sensitive labels having at least one leading edge and at least one trailing edge and detachably mounted thereon to a supply reel, threading the strip over a series of rollers and through a linear clamping mechanism having an upstream clamping device and a downstream clamping device, conveying the strip to a detaching station, mounting the strip on a take-up reel, closing the upstream clamping device to clamp against the label carrying strip, moving the upstream clamping device and clamped strip along a distance toward the downstream clamping device to pull an additional segment of strip from the supply reel and to feed a corresponding length of segment of strip to the take-up reel, sensing at least one leading edge and at least one trailing edge of the labels during the moving step and varying the distance the upstream clamping device and clamped strip is moved so as to substantially maintain even spacing between adjacent labels, passing the strip over the acute angle of a peeling member in the detaching station to move the strip in a bend greater than 90°, peeling each label from the strip as the strip moves in the bend, sequentially lifting each peeled label from the detaching station, transferring the peeled strip to an applicating station, and pressing each peeled label against a respective object in the applicating station to attach the label to the object.

27. The method of claim 26 wherein said clamping devices are air actuated solenoids, and including the step of passing the strip through a spring loaded mechanism which is actuated for holding the strip when the applied air pressure drops to a minimum level.

28. The system of claim 27 wherein the objects are bottles having caps, and applying each label to a side of each bottle.

29. The system of claim 28 including sensing missing bottles and missing caps prior to the step of applying the label to a bottle.

30. An automatic motorless label applying system comprising a supply reel having a continuous carrier strip with a plurality of pressure sensitive labels each having at least one leading edge and at least one trailing edge and being detachably mounted on said carrier strip, a linear indexing mechanism, said linear indexing mechanism comprising an upstream clamping device and a downstream clamping device, said upstream clamping device including an upper clamp member and a lower clamp member with said label carrying strip passing therebetween, means for relatively moving said upstream clamp members toward each other to clamp said label carrying strip therebetween, means for moving said upstream clamping device laterally along a distance toward said downstream clamping device when said upstream clamping device is in its clamped condition and for returning said upstream clamping device away from said downstream clamping device when said upstream clamping device is in its unclamped condition, said downstream clamping device being laterally fixed, said downstream clamping device including an upper clamp member and a lower clamp member with said label carrying strip passing therebetween, means for relatively moving said downstream clamp members toward each other to clamp said label carrying strip therebetween while said upstream clamping device is moved in its returning direction, means for sequentially peeling each label from said carrying strip at a detaching station, means for feeding objects one at a time to an applicating station, means for removing each label from said detaching station and applying said label to a respective object at said applicating station, means for sensing at least one leading edge and at least one of the trailing edge of the labels and for sending information when said sensed at least one leading edge and when said sensed at least one trailing edge of a label pass through the sensing means, and means for controlling the lateral movement of the upstream clamping device which receives the information from the sensing means to vary the distance the upstream clamping device is laterally moved so as to substantially correct for uneven spacing between adjacent labels on the continuous carrier strip.

31. A method of applying labels to objects with the use of an automatic motorless label applying system including the steps of mounting a continuous carrier strip having a plurality of pressure sensitive labels having at least one leading edge and at least one trailing edge and detachably mounted thereon to a supply reel, threading the strip over a series of rollers and through a linear clamping mechanism having an upstream clamping device and a downstream clamping device, conveying the strip to a detaching station, mounting the strip on a take-up reel, closing the upstream clamping device to clamp against the label carrying strip, moving the upstream clamping device and clamped strip along a distance toward the downstream clamping device to pull an additional segment of strip from the supply reel and to feed a corresponding length of segment of strip to the take-up reel, sensing at least one leading edge and at least one trailing edge of the labels during the moving step and varying the distance the upstream clamping device and clamped strip is moved so as to substantially correct for uneven spacing between adjacent labels on the continuous carrier strip, passing the strip over the acute angle of a peeling member in the detaching station to move the strip in a bend greater than 90°, peeling each label from the strip as the strip moves in the bend, sequentially lifting each peeled label from the detaching station, transferring the peeled strip to an applicating station, and pressing each peeled label against a respective object in the applicating station to attach the label to the object.

* * * * *